US006792127B1

(12) United States Patent
Anthony et al.

(10) Patent No.: US 6,792,127 B1
(45) Date of Patent: Sep. 14, 2004

(54) ELLIPTICAL DOME FOR HIGH FREQUENCY TRANSDUCER

(75) Inventors: Philip Jeffrey Anthony, Kent (GB); Julian Roger Wright, Kent (GB)

(73) Assignee: KEF Audio (UK) Limited, Maidstone (GB)

( * ) Notice: Subject to any disclaimer, the term of this patent is extended or adjusted under 35 U.S.C. 154(b) by 0 days.

(21) Appl. No.: 09/521,911

(22) Filed: Mar. 9, 2000

(30) Foreign Application Priority Data

Oct. 29, 1999 (GB) ..... 9925674

(51) Int. Cl.[7] ..... H04R 25/00
(52) U.S. Cl. ..... 381/430; 381/407
(58) Field of Search ..... 381/396, 398, 381/400, 407, 423, 424, 427, 430, FOR 162; 181/168, 173

(56) References Cited

U.S. PATENT DOCUMENTS

| | | | | | |
|---|---|---|---|---|---|
| 2,392,143 | A | * | 1/1946 | Graham | 381/398 |
| 3,935,400 | A | * | 1/1976 | Koga | 381/430 |
| 4,135,601 | A | | 1/1979 | Tsukagoshi | |
| 4,709,392 | A | * | 11/1987 | Kato et al. | 381/427 |
| 4,799,266 | A | | 1/1989 | Sakamoto et al. | |
| 5,150,419 | A | | 9/1992 | Kizak | |
| 5,181,253 | A | | 1/1993 | Jordan | |
| 5,548,657 | A | | 8/1996 | Fincham | |
| 5,664,024 | A | * | 9/1997 | Furuta et al. | 381/396 |
| 6,154,556 | A | * | 11/2000 | Takahashi et al. | 381/430 |
| 6,222,931 | B1 | * | 4/2001 | Cesati | 381/430 |

FOREIGN PATENT DOCUMENTS

| | | |
|---|---|---|
| EP | 040948 | 12/1981 |
| EP | 0040948 A1 | 12/1981 |
| EP | 82302711.5 | 5/1982 |
| EP | 0235991 A2 | 9/1987 |
| EP | 235991 | 9/1987 |
| EP | 0341926 A1 | 11/1989 |
| EP | 341926 | 11/1989 |
| EP | 0644706 A1 | 3/1995 |
| EP | 644706 | 3/1995 |
| GB | 549643 | 5/1941 |
| GB | 2099660 A | 5/1982 |
| GB | 2099660 | 12/1982 |
| JP | JO 4058700 | 2/1992 |
| JP | 4-58700 | 5/1995 |
| WO | WO 99/41940 | 8/1999 |

* cited by examiner

*Primary Examiner*—Suhan Ni
(74) *Attorney, Agent, or Firm*—Kenneth L. Sherman; Myers Dawes Andras & Sherman, LLP

(57) ABSTRACT

A high frequency transducer having a dome diaphragm with a configuration of a bisected ellipse to overcome the distortion and breaking point of prior art even domes at frequencies above 30 kHz. The dome diaphragm having an annular skirt extending therefrom in an integral fashion and connecting to a disc shaped plate of the transducer. A voice coil of cylindrical section being directly connected to the skirt at a region of close proximity to said dome. The dome being constructed of a rigid material such as a metal, an alloy, a metalloid such as, but not limited to, titanium, aluminum, and boron, or a combination thereof. The dome being constructed in accordance with a general formula for an ellipse $(x^2/a^2)+(y^2/b^2)=1$, and a>b. Wherein a is half of the distance of major axis and b is half of the distance of a minor axis.

23 Claims, 4 Drawing Sheets

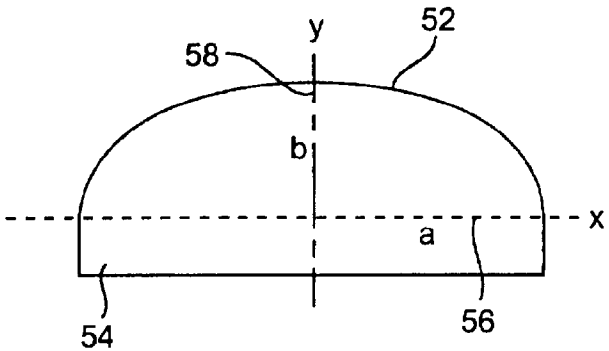
FIG. 4
FIG. 5
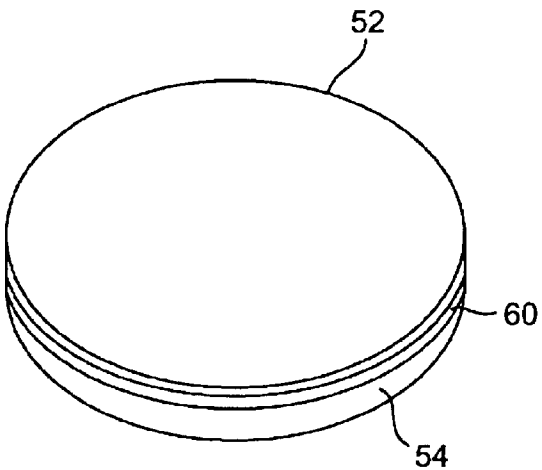
FIG. 6
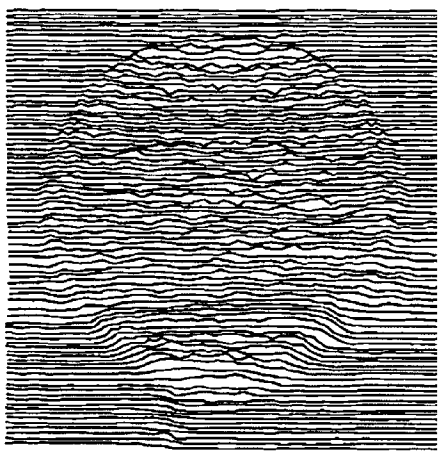
FIG. 7

ELLIPTICAL DOME FOR HIGH FREQUENCY TRANSDUCER

FIELD OF THE INVENTION

This invention relates to dome type transducers and particularly to high frequency transducers that have elliptical domes for improved mechano-acoustical strength and performance.

BACKGROUND OF THE INVENTION

For production of higher audio frequencies, loudspeakers have been used in the art. Loudspeakers used to generate higher audio frequencies have conventionally used a dome type loudspeaker. Conventionally, vibrating domes used as the radiating element in loudspeakers have been designed as a truncated hemisphere in section, and to a tubular section at the periphery, as shown in FIG. 1. The dome and the tubular section may be one part or independent units adapted to connect to one another. The tubular section is connected to a moving electromagnetic coil and the diaphragm and the coil are suspended in an air gap created by pole pieces of a permanent magnet and supplied with an electric current that is representative of the sounds to be reproduced. As a result of the magnetic forces, the radiating dome is moved toward or away from a listener. As the dome moves forward, it compresses the air in front of it and as the dome moves backward it rarefies the air in front of it. The compressions and rarefactions result in the sound produced.

However, at higher frequencies the dome will reach the limits of its motion and result in failure. Using Finite Element Analysis and Laser Vibrometry, the mechano-acoustical design of these prior art domes were shown to exhibit flexure and resonance below 30 kHz, resulting in mechanical breakup and inferior acoustic performance. The resulting breakup occurred at the outer periphery of the dome where the vibration is concentrated in a dome type loudspeaker. As shown in FIG. 2, at 22 kHz the prior art dome structures began to show flexing at the periphery of the dome resulting in breakup and inferior acoustic performance. The breakup at the periphery causes the dome and the voice coil to vibrate in a disordered state and thus produce a high "Q" peak in the frequency response curve. As a result of the breakup, the sound radiated from the high frequency diaphragm dome is ragged and unclear due to deterioration of transmissibility of vibration of the voice coil.

SUMMARY OF THE INVENTION

Accordingly, it is general object of the present invention to overcome the disadvantages of the prior art.

In particular, it is an object of the present invention to provide a dome that can operate at higher frequencies.

It is another object of the present invention to provide a dome for high frequency transducers that maintains mechanical strength and acoustical performance at increasing frequencies.

It is yet another object of the present invention to provide a dome for high frequency transducers that maintains mechanical strength and acoustical performance at frequencies above 30 kHz.

It is another object of the present invention to provide a dome for high frequency transducers that has an increased stiffness at the outer periphery thereof.

It is another object of the present invention to provide a dome for high frequency transducers that has an integral skirt extending therefrom to provide for a strengthened outer periphery.

It is still another object of the present invention to provide a dome for high frequency transducers that has a radius at the periphery thereof in order to buttress the outer periphery thereof.

It is another object of the present invention to provide a dome for high frequency transducers that incorporates the voice coil as an element in fortifying the outer periphery thereof.

It is yet another object of the present invention to provide a dome for high frequency transducer that are adapted to function with a variety of magnetic systems used in a variety of loudspeakers.

In keeping with the principles of the present invention, a unique high frequency transducer is presented which overcomes the shortfall of the prior art. It is to be understood that the high frequency transducer is an element that is incorporated into a loudspeaker as is known in the art. The high frequency transducer has a magnet pot with an annular rim extending therefrom. Magnet pot and rim have an inner surface and an outer surface, and a disc shaped magnet is received within said inner surface. A channel is created between an outer circumference of the magnet and the inner surface of the annular rim.

A disc shaped pole is positioned on top of the magnet. An annular lip extends inwardly from the rim and is planar with a pole, however a non-magnetic annular air gap is defined therebetween, thus resulting in an outer pole. The magnet is preferably neodymium iron boron but may be substituted with any other materials having magnet properties substantially similar or superior thereto. An annular holder is positioned on top of and outside the rim and is substantially "L" shaped. The annular holder has at least a cavity extending therein to accommodate a terminal extending therethrough to outside connectors.

An elliptical dome has an annular skirt extending therefrom at an outer periphery in an integral and unitary fashion. The skirt connects with the pole at a side opposing the dome. The elliptical dome is bisected axially and has a major axis extending from a first side of the skirt to a directly opposing side. The dome has a minor axis extending perpendicularly from the major axis to the apex of the dome. The elliptical dome is constructed in accordance with the following general formula for an ellipse: $(x^2/a^2)+(y^2/b^2)=1$, and $a>b$. The dome can be of varying sizes as long as the general formula is adhered to.

The dome and the skirt are constructed of a rigid material in an integral and unitary fashion to provide further strength to the structure at higher frequency ranges. The dome is constructed from a variety of materials such as metals, alloys, metal matrices, and metalloids.

A voice coil, that is preferably cylindrical in section, is wound around and attached directly to the skirt. To further strengthen the structure, the coil is wound as close as possible to the transitional region between the dome and the skirt. An annular surround is attached directly to the dome at a first periphery portion and to a spacer at a second periphery portion thereof, the spacer being in turn attached to the rim.

As constructed, the mechanical strength of the structure is reinforced and the acoustical performance of the high frequency transducer is significantly improved even at frequencies above 30 kHz.

Such stated objects and advantages of the invention are only examples and should not be construed as limiting this invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS:

It is to be understood that the drawings are to be used for the purposes of illustration only and not as a definition of the limits of the invention. It is also to be understood that although in the figures a symmetrical apparatus is illustrated, the same elements are also applicable to an asymmetrical apparatus.

In the drawings, wherein similar reference characters denote similar elements throughout the several views:

FIG. 4 is an elevational view of the elliptical dome with an integral skirt having a voice coil thereon.

FIG. 5 is a cross-sectional view of an elliptical dome and the skirt taken along line 5—5 of FIG. 4.

FIG. 6 is a perspective view of the elliptical dome with the skirt extending therefrom and a voice coil connected thereto.

FIG. 7 is a laser scan of the elliptical dome at 22 kHz illustrating the decreased breakup in the outer periphery of the dome.

Figure 1:
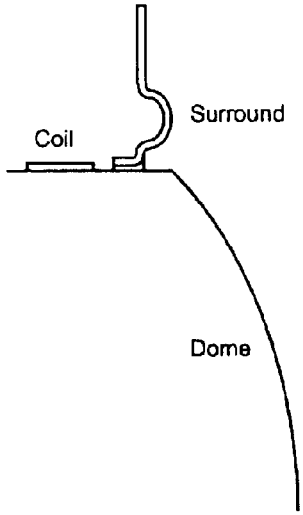
(PRIOR ART) FIG. 1
FIG. 1 is a partial cross-sectional view of a prior art transducer illustrating the dome, skirt, coil, and surround.
Figure 2:
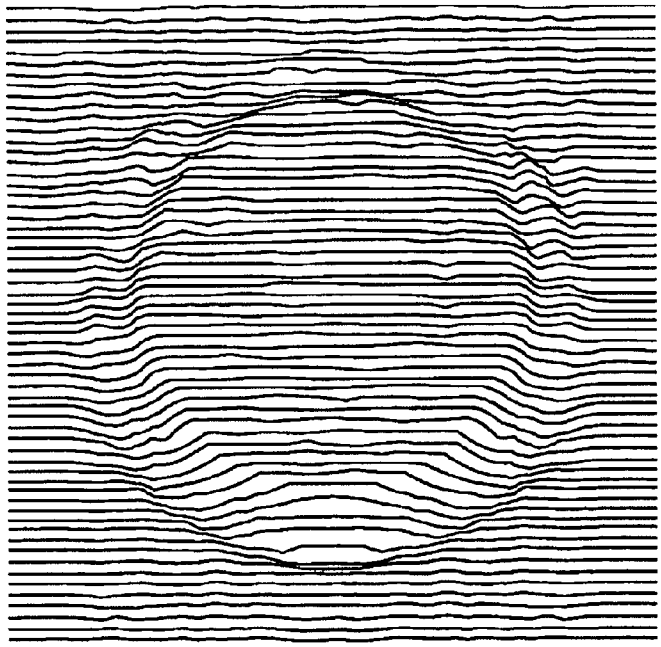
FIG. 2 is a laser scan of a prior art dome at 22 kHz illustrating the breakup in the periphery of the dome structure.
Figure 3:
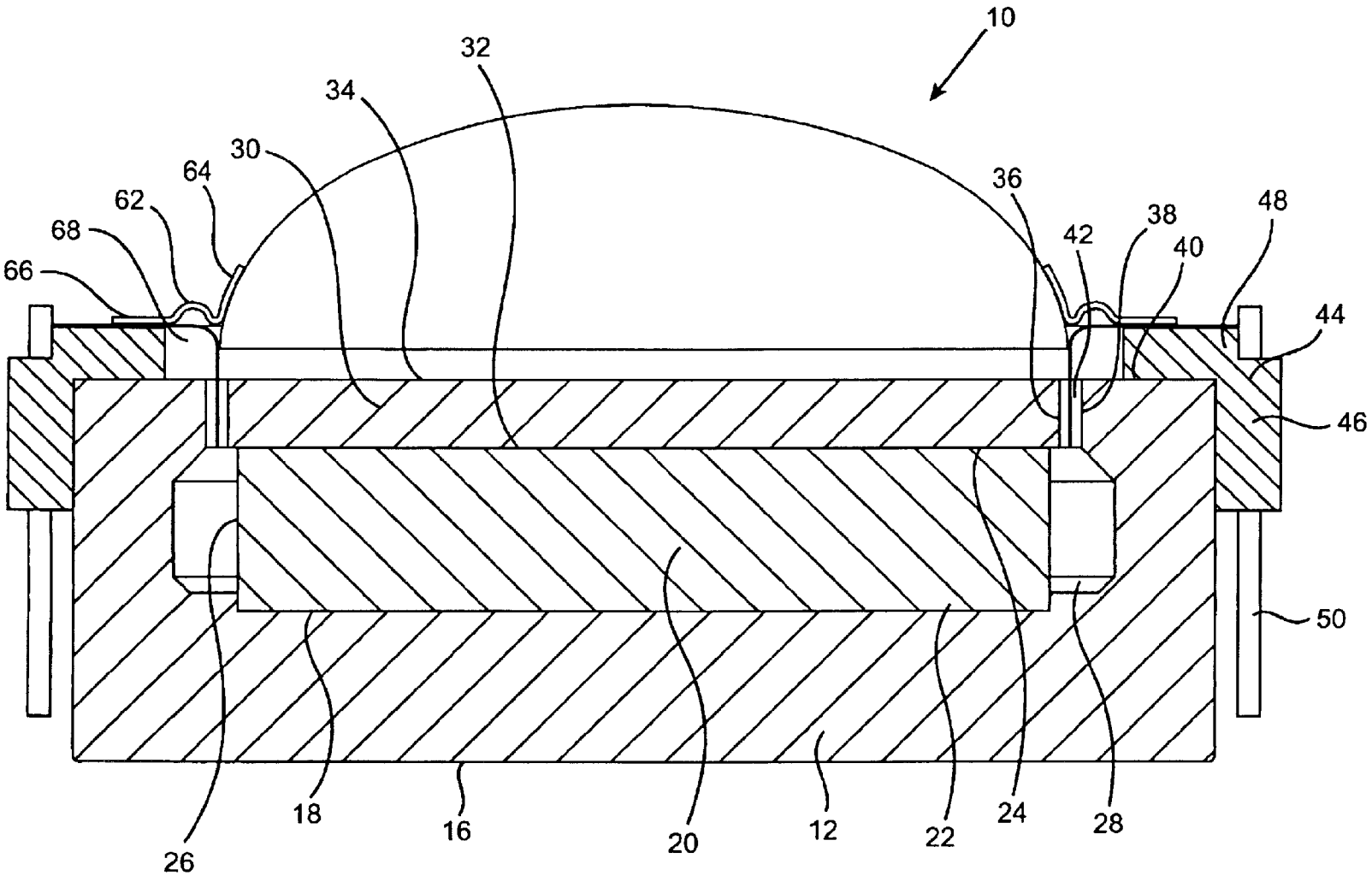
FIG. 3 is a cross-sectional view of a high frequency transducer having an elliptical dome.

DETAILED DESCRIPTION OF THE INVENTION:

Referring to FIG. 3, therein is illustrated an axial cross sectional view of a high frequency transducer 10. The high frequency transducer 10 is a structure that is usually incorporated into a loudspeaker unit (not shown) as is known in the art. Therefore, it is to be understood that a low frequency transducer having a magnet structure, a voice coil, and a diaphragm of generally frusto-conical form is incorporated into the high frequency transducer 10 by any means that are known in the art.

Transducer 10 has a magnet pot 12 with an annular rim 14 extending therefrom. Magnet pot 12 may have a generally cylindrical outer surface 16 and adapted to function with any low frequency transducer known in the art. Magnet pot 12 has an inner surface 18 wherein an annular recess is defined by rim 14 and magnet pot 12. A disc shaped magnet 20 has a bottom 22 and a top 24 interconnected by an outer wall 26. Magnet 20 is received within magnet pot 12 such that bottom 22 is disposed upon inner surface 18. Outer wall 26 of magnet 20 is not in contact with inner surface 16 of rim 14 and an annular channel 28 is defined therebetween.

A disc shaped pole 30 has a first side 32 and a second side 34 interconnected by an outer edge 36. Pole 30 is positioned over magnet 20 such that first side 32 of pole 30 engages top 24 of magnet 20. An annular lip 38 extends inwardly from an upper portion 40 of rim 14. Pole 30 is maintained within a similar plane as lip 38 such that circular outer edge 36 is equidistantly spaced therefrom forming an outer pole. A non-magnetic air gap 42 is defined between outer edge 36 of pole 30 and lip 38 of magnet pot 12.

Preferably, magnet 20 is formed from neodymium iron boron which allows a very substantially enhanced magnetic field strength as compared with other available magnetic materials to be attained in the air gap between the poles. However, it will be appreciated that magnet 20 may be formed of other materials having magnetic properties substantially similar or superior to that of neodymium iron boron. In addition, ceramic magnet assemblies may also be used and the transducer 10 may be adapted to accommodate such a structure as is known in the art.

A holder 44, having an annular shape, is positioned over rim 14 of magnet pot 12. Holder 44 has a vertical portion 40 that connects to outer surface 16 of rim 14 of magnet pot 12, and a horizontal portion 48 that connects to upper portion 40 of rim 14. Vertical portion 46 has at least a cavity extending axially therein to accommodate a terminal 50 extending therefrom to external connectors (not shown).

Now also referring to FIG. 4, a dome 52 has an annular skirt 54 extending therefrom at an outer periphery. Skirt 54 communicates with second side 34 of pole 30 at an end opposing dome 52. Now also referring to FIG. 5, dome 52 has an elliptical shape if bisected axially and forms a major axis 56 running from a first side of skirt 54 to an opposing side of skirt 54, and has a minor axis 58 perpendicular thereto. The elliptical shape is constructed in accordance with a general formula $(x^2/a^2)+(y^2/b^2)=1$, and $a>b$. The dome 52 can be of varying sizes as long as the general formula is adhered to. In a range of preferred embodiments, the ratio of a to b would lie in between 1.4 and 2.6 inclusive. In a more specific preferred embodiment, the ratio of a to b would be 1.75 wherein a 12.7275 mm and b=7.789 mm.

Dome 52 and skirt 54 are preferably constructed as an integral unit to increase the structural strength and acoustic performance thereof. Dome 52 may be constructed of a variety of rigid materials, and in a preferred embodiment, dome 52 is constructed from a plurality of metals such as, but not limited to, titanium or aluminum. Dome 44 may also be constructed from a plurality of alloys composed of two or more metals, or of a metal or metals with one or more non-metals. The alloy may be composed of a metal matrix composite comprising one or more metals and one or more metalloids such as, but not limited to, aluminum and boron. In a preferred embodiment, "BORALYN" the trademark for a metal matrix composite is used in the construction of the dome and is commercially available from Alyn Coporation of Irvine, Calif., USA.

Now also referring to FIG. 6, a voice coil 60 that is preferably cylindrical in section, is wound around skirt 54 and directly connected thereto. In order to further strengthen the structure of dome 52 at higher frequencies, coil 60 is preferably wound as close as possible to the transition region wherein dome 52 extends into skirt 54. A surround 62 having an annular shape and being flexible in nature is connected to an outer periphery of dome 52 at a first edge 64, and connects to horizontal portion 48 of holder 44 at a second edge 66. As a result, an annular void 68 is defined by skirt 54, surround 62, and horizontal portion 48 of holder 44.

Voice coil 60 is connected to a lead out conductor 70 that extends out from the dome region. Lead out conductor 70 extends through and in between surround 62 and horizontal portion 46 of holder 44. Lead out conductor 70 then connects to terminal 50 and is extended out it through the cavity extending through vertical portion 46 to external connectors (not shown).

Now referring to FIG. 7, once again using Laser Vibrometry, the mechano-acoustical design of the present invention having the elliptical dome was monitored. Tested at a similar frequency of 22 kHz as in the experiment with the prior art transducer, the flexure and resonance is at the periphery of the elliptical dome is significantly decreased in comparison to the prior art. As a result, breakup was not experienced and the dome and the voice coil maintained an orderly vibration and did not produce a high "Q" peak in the frequency response curve. In addition, as a result of the elliptical design, bending and flexure was moved towards the apex of the dome and away from the periphery. As a result, the acoustical and mechanical performance of the elliptical dome was enhanced at increasing frequencies, even above 30 kHz.

Figure 8:
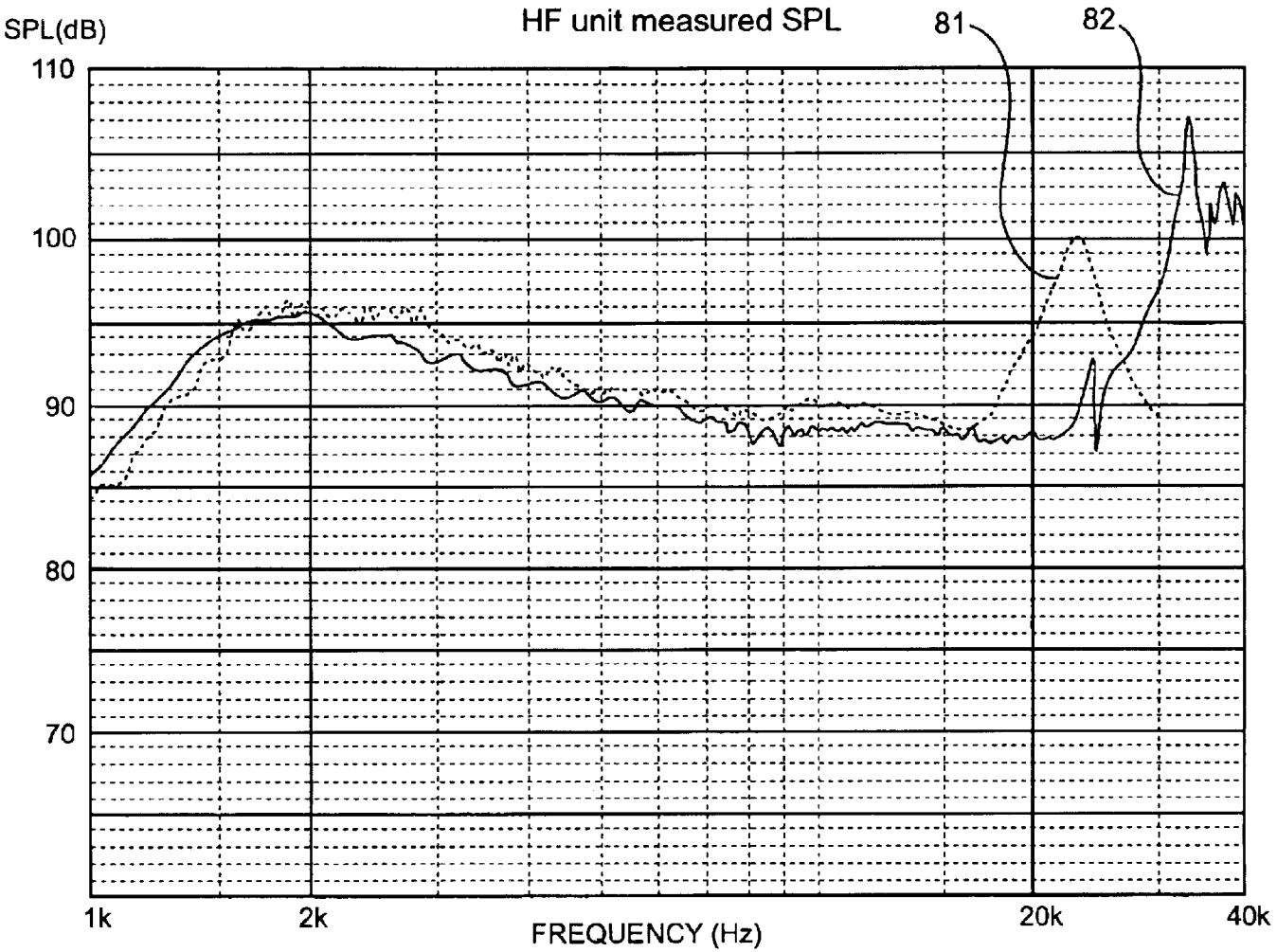
FIG. 8 is a graph of the frequency response of the elliptical dome compared to the prior art dome measuring the sound pressure levels in dB.

Referring now to FIG. 8, to compare the acoustic performance of the prior art dome and the elliptical dome a frequency response measurement was conducted. The prior art dome (shown by characteristic 81) has a high 'Q' peak at 22.9 kHz, whereas the elliptical dome of this invention (shown by characteristic 82) does not show this peak until a frequency of 32.9 kHz thus increasing its upper working frequency from approximately 20 kHz to approximately 30 kHz.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. A high frequency transducer including a radiating diaphragm, comprising:

a dome portion having a substantially elliptical shape along a diameter thereof when bisected axially and an annular skirt portion extending therefrom and both of said dome portion and said annular skirt portion being formed from a unitary piece;

a voice coil connected to said skirt portion;

a disc shaped plate communicating with said skirt portion, and a magnet connecting to the plate; and an annular magnet pot receiving said magnet, wherein said substantially elliptical shape is determined in accordance with a formula $(x^2/a^2)+(y^2/b^2)=1$, and a is equivalent to a length of half of a major axis and b is equivalent to a length of half of a minor axis, and a>b, and wherein a ratio of said major axis and said minor axis ranges in between 1.4 and 2.6 inclusive.

2. The high frequency transducer of claim 1, wherein said dome portion is comprised of a substantially rigid material.

3. The high frequency transducer of claim 2, wherein said rigid material is a metal.

4. The high frequency transducer of claim 2, wherein said rigid material is an alloy.

5. The high frequency transducer of claim 1, wherein said dome portion is comprised of an alloy consisting of at least boron, titanium, and aluminum.

6. The high frequency transducer of claim 4, wherein said alloy comprises a metal matrix of at least a metal and a metalloid.

7. The high frequency transducer of claim 4, wherein said alloy comprises a BORALYN.

8. The high frequency transducer of claim 1, wherein said ratio of said major axis and said minor axis is approximately 1.75.

9. The high frequency transducer of claim 1, wherein said voice coil is cylindrical in section.

10. The high frequency transducer of claim 1, wherein said voice coil is directly connected to said skirt at a region of transition from said dome to said skirt.

11. A high frequency transducer including a radiating diaphragm, comprising:

a dome portion having a substantially elliptical shape along a diameter thereof when bisected axially and an annular skirt portion extending therefrom and both of said dome portion and said annular skirt portion being formed from a unitary piece, wherein the skirt portion is a smooth transition of the dome;

a voice coil connected to said skirt portion at said smooth transition, wherein the skirt and said voice coil fortify the periphery of the dome;

a disc shaped plate communicating with said skirt portion, and a magnet connecting to the plate; and an annular magnet pot receiving said magnet.

12. The high frequency transducer of claim 11, wherein said dome portion is comprised of a substantially rigid material.

13. The high frequency transducer of claim 12, wherein said rigid material is a metal.

14. The high frequency transducer of claim 12, wherein said rigid material is an alloy.

15. The high frequency transducer of claim 11, wherein said dome comprises an alloy consisting of at least boron, titanium, and aluminum.

16. The high frequency transducer of claim 11, wherein said alloy comprises a metal matrix of at least a metal and a metalloid.

17. The high frequency transducer of claim 11, wherein said substantially elliptical shape is observed when bisected along a major axis thereof.

18. High frequency transducer of claim 11, wherein said substantially elliptical shape is determined in accordance with a formula $(x^2/a^2)+(y^2/b^2)=1$, and a is equivalent to a length of half of a major axis and b is equivalent to a length of half of a minor axis, and a>b.

19. The high frequency transducer of claim 19, wherein a ratio of said major axis and said minor axis ranges in between 1.4 and 2.6 inclusive.

20. The high frequency transducer of claim 18, wherein a ratio of said major axis and said minor axis is approximately 1.75.

21. A high frequency transducer including a radiating diaphragm, comprising:

a dome portion having a substantially elliptical shape along a diameter thereof when bisected axially and an annular skirt portion extending therefrom and both of said dome portion and said annular skirt portion being from a unitary piece, wherein the dome comprises a metal matrix composite material of at least a metal and a metalloid;

a voice coil connected to said skirt portion;

a disc shaped plate connected to said skirt portion, and a magnet connecting to the plate; and an annular magnet pot receiving said magnet.

22. The high frequency transducer of claim 21, wherein metal matrix composite material further comprises a non-metal.

23. The high frequency transducer of claim 21, wherein said metal matrix composite material is "BORALYN."

* * * * *